United States Patent [19]

Postma

[11] 4,380,715

[45] Apr. 19, 1983

[54] COLOR TELEVISION DISPLAY TUBE WITH RESISTOR FOR INTERFERENCE RADIATION REDUCTION

[75] Inventor: Gosse J. Postma, Eindhoven, Netherlands

[73] Assignee: U.S. Philips Corporation, New York, N.Y.

[21] Appl. No.: 191,042

[22] Filed: Sep. 25, 1980

[30] Foreign Application Priority Data

Oct. 15, 1979 [NL] Netherlands ..... 7907596

[51] Int. Cl.[3] ..... H01J 29/96; H01J 29/88; H01J 29/81

[52] U.S. Cl. ..... 315/3; 313/408; 313/479

[58] Field of Search ..... 313/479, 408, 407; 315/3

[56] References Cited

U.S. PATENT DOCUMENTS

| | | | |
|---|---|---|---|
| 3,295,008 | 12/1966 | Gallaro et al. | 315/3 |
| 3,502,942 | 3/1970 | Khan et al. | 313/408 X |
| 3,931,541 | 1/1976 | Brenner, Jr. | 313/407 |
| 4,188,564 | 2/1980 | Zegers et al. | 313/479 |

FOREIGN PATENT DOCUMENTS

| | | | |
|---|---|---|---|
| 2520426 | 9/1976 | Fed. Rep. of Germany | 313/408 |
| 2611640 | 9/1976 | Fed. Rep. of Germany . | |
| 54-150965 | 11/1979 | Japan | 313/479 |

*Primary Examiner*—Palmer C. Demeo
*Attorney, Agent, or Firm*—Robert J. Kraus

[57] ABSTRACT

Interference radiation produced by a color television tube during operation is reduced by incorporating a resistor of approximately 5 kOhm to 100 kOhm between a shadow mask and a conductive layer on the tube's display screen. This resistor reduces by 4–6 dB electromagnetic energy radiated by the tube in the frequency band of approximately 150 kHz to 1.5 MHz.

3 Claims, 3 Drawing Figures

COLOR TELEVISION DISPLAY TUBE WITH RESISTOR FOR INTERFERENCE RADIATION REDUCTION

BACKGROUND OF THE INVENTION

The invention relates to a colour television display tube comprising an envelope having a neck, a cone, and a window, an electrode system provided in the neck to generate a number of electron beams, a display screen provided internally on the window and covered with an electrically conductive layer, and a shadow mask which is situated at a short distance from the display screen and which is electrically connected to the conductive layer provided on the display screen.

Such a colour television display tube is known, for example, from German Offenlegungsschrift No. 26 11 640. The resistance of the electric connection between the shadow mask and the display screen disclosed therein is made very small to maintain the shadow mask and the display screen at the same electrical potential during operation of the display tube.

As is known, an operating television receiver may be a source of interference for a radio receiver located nearly and tuned to a frequency in the long-wave or medium-wave band. This interference consists of electro-magnetic radiation in the frequency range from 150 kHz to approximately 1.5 MHz which originates from the video signal itself (video interference radiation) and from the deflection coils (deflection interference radiation). The video interference radiation results from the display screen being scanned with an electron beam modulated by the video signal. As a result of this the display screen potential fluctuates with the amplitude of the video signal, which fluctuations result in the emission of radiation in the above-mentioned frequency range by the display tube. The deflection interference radiation results inter alia from higher harmonics of the line flyback pulse being capacitively coupled to the conductive inner coating of the display tube and propagating via coupling capacities and resistances to the display screen and thence being radiated in the form of electro-magnetic energy.

SUMMARY OF THE INVENTION

It is an object of the invention to provide a colour television display tube including means for reducing the interference radiated by the tube.

In accordance with the invention, a colour television display tube's shadow mask electrically connected to the conductive layer provided on the display screen by a resistance of approximately 5 kOhm to 100 kOhm. It has been found that in a display tube according to the invention the energy radiated by the display tube in the interfering frequency band is approximately 4 to 6 dB lower than in a display tube in which the shadow mask is connected by a low resistance (a few tens of Ohms) to the display screen. It has also been found that the incorporation of a resistor between shadow mask and display screen is more effective at reducing deflection interference radiation than it is at reducing video interference radiation. Within the interfering frequency band, a reduction of the deflection interference radiation level of approximately 6 dB is obtained with a resistor of approximately 10 kOhm between shadow mask and display screen. This reduction decreases fro lower resistance values and is substantially constant for higher resistance values. With respect to the video interference radiation, a small increase of the video interference radiation (approximately 2 dB) is obtained at frequencies of approximatey 150 kHz, while at frequencies near 1.5 MHz a small reduction of the video interference radiation level (approximately 2 dB) is obtained. It has been found that the overall interference radiation level is reduced by approximately 4 to 6 dB for resistance values between 5 kOhm and 100 kOhm in the interfering frequency range The resistance between the shadow mask and the display screen is preferably not higher than approximately 100 kOhm. Higher resistance values enable an electric field to be established between the shadow mask and the display screen when the electron beam currents vary. Such an electric field influences the direction of the electron beams which enter the space between the shadow mask and the display screen at an angle with the direction of the electric field.

It is to be noted that German Auslegeschrift No. 25 20 426, corresponding to British Pat. No. 1,485,358, discloses a display tube in which a resistor of 500 kOhm to 3 MOhm is incorporated between a shadow mask and a display screen, for the purpose of building up an electric field between the shadow mask and the display screen which exerts a correcting influence on the direction of the electron beams when the beam current increases, so as to compensate for lateral displacements of the mask apertures caused by temperature effects. Such an influence is not an object of the present invention.

BRIEF DESCRIPTION OF THE DRAWING

The invention will now be described in greater detail, by way of example, with reference to the accompanying drawing, in which.

DESCRIPTION OF THE PREFERRED EMBODIMENTS

Figure 1:
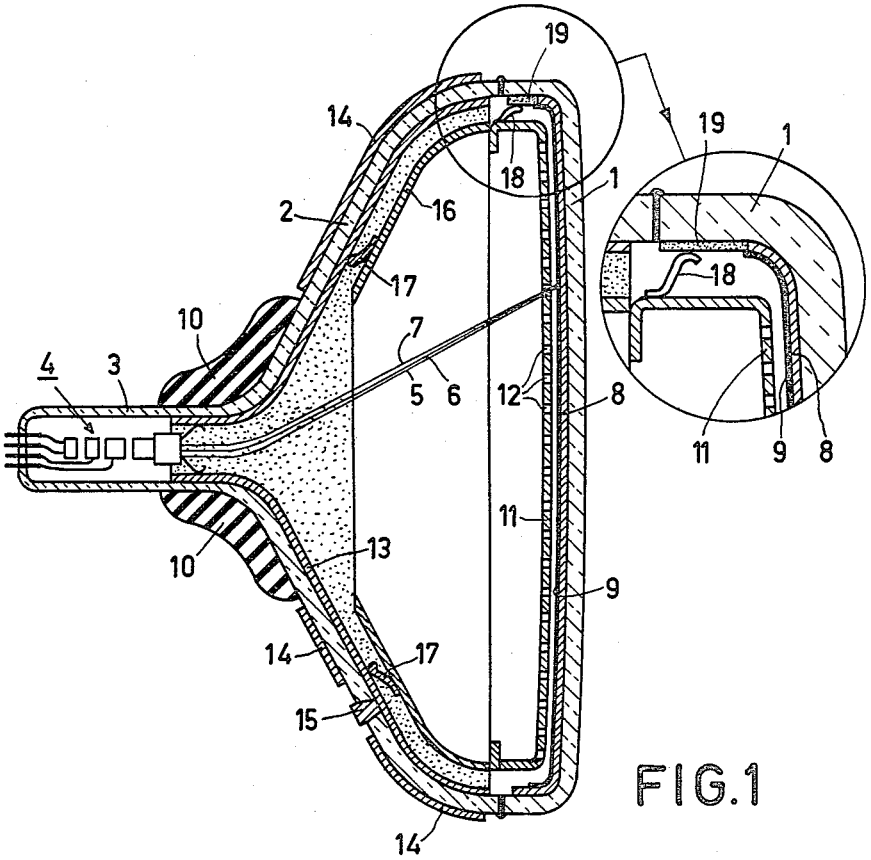
FIG. 1 is a diagrammatic cross-sectional view of a colour television display tube according to the invention.

The tube shown in FIG. 1 comprises a glass envelope including a display window 1, a cone 2, and a neck 3. An electrode system 4 having three electron guns to generate three electron beams 5, 6 and 7 is provided in the neck 3. The electron beams are generated in one plane (in this case the plane of the drawing) and are directed onto a display screen 8 provided internally on the display window 1 and consisting of a large number of phosphor strips coated with an aluminium layer 9 and luminescing in red, green and blue. The longitudinal direction of the strips extends perpendicularly in the plane through the electron guns.

On their way to the display screen 8, the electron beams 5, 6 and 7 are deflected over the display screen 8 by means of a number of deflection coils 10 placed coaxially around the tube axis, and pass through a colour selection electrode 11 (shadow mask) consisting of a metal plate having oblong apertures 12, the longitudinal direction of which is parallel to the phosphor strips of the display screen 8. The three electron beams 5, 6 and 7 pass through the apertures 12 at a small angle with each other and each impinges only on phosphor strips of a respective colour.

The tube further comprises an internal electrically conductive layer 13 and a conductive layer 14 provided externally on the cone 2. The conductive layer 13 is connected to a high-voltage contact 15 provided in the cone wall. The shadow mask 11 contacts a resistance layer 19 by means of a metal spring 18, and layer 19 in turn makes electrical contact with the aluminium layer 9. The resistance layer 19 comprises a mixture of graphite powder, iron oxide powder ($Fe_2O_3$) and an inorganic binder, such as potassium silicate or sodium silicate, providing a resistance of approximately 10 kOhm in the electrical connection path between shadow mask 11 and aluminium layer 9. Any suitable resistance material may be chosen for the resistance layer 19 which is provided in the form of a strip.

The tube also comprises a metal screening cone 16 which is connected at one end to the colour selection electrode 11 and at the other end to the conductive layer 13 by means of two contact springs 17. During operation of the tube, the layer 13 is at an operating potential of approximately 25 kilovolts and the layer 14 is at earth potential.

Figure 2:
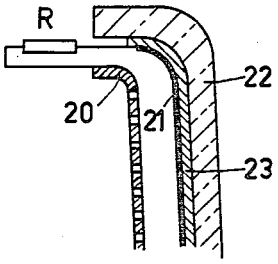
FIG. 2 and FIG. 3 show two embodiments in accordance with the invention.

FIG. 2 shows another embodiment in accordance with the invention, in which a shadow mask 20 is connected to the aluminium coating 21 via a discrete resistor R of approximately 10 kOhm. The aluminium coating 21 is provided on a display screen 23 covering the display window 22.

Figure 3:
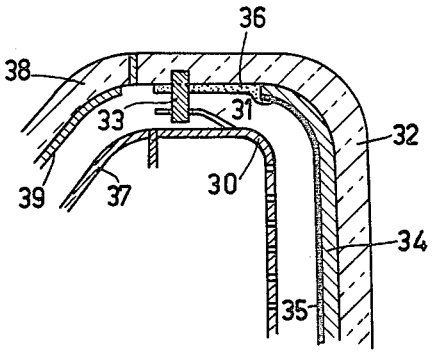

In FIG. 3*a* shadow mask 30 is connected in the display window 32 by means of metal suspension springs 31. The suspension springs 31 (one of which is shown) each have an aperture which cooperates with a metal pin 33 sealed in the display window. Aluminium coating 35 provided on display screen 34 is electrically connected to the metal pin 33 by means of a strip-shaped resistive layer 36, which determines the electrical resistance in the connection path from the shadow mask 30 to the aluminium coating 35. The connection between conductive coating 39, provided on cone 38, and metal screening cone 37 can be effected by means such as that shown in FIG. 1.

What is claimed is:

1. A color television display tube comprising an envelope having a neck, a cone and a window, an electron beam producing means located in said neck, a display screen provided on the internal surface of said window and covered with an electrically conductive layer, a shadow mask situated at a short distance from the display screen, and means for electrically connecting the shadow mask to the conductive layer, said electrical connection means having a resistance of approximately 5 kOhms to 100 kOhms.

2. A color television display tube as in claim 1, wherein said electrical connection means comprises a discrete resistor.

3. A color television display tube as in claim 1, wherein said electrical connection means comprises a resistive coating on a portion of the internal surface of the window, said coating abutting the conductive layer, and conductive means for connecting said shadow mask to a predetermined portion of said resistive layer.

* * * * *